US007764911B2

(12) United States Patent
Itabashi

(10) Patent No.: US 7,764,911 B2
(45) Date of Patent: Jul. 27, 2010

(54) DEVELOPER UNIT, PROCESS DEVICE AND IMAGE FORMING APPARATUS

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 207 days.

(21) Appl. No.: 12/163,365

(22) Filed: Jun. 27, 2008

(65) Prior Publication Data

US 2009/0035028 A1 Feb. 5, 2009

(30) Foreign Application Priority Data

Jun. 29, 2007 (JP) ..... 2007-173515

(51) Int. Cl.
*G03G 15/08* (2006.01)

(52) U.S. Cl. ..... 399/281; 399/119; 399/286

(58) Field of Classification Search ..... 399/107, 399/111, 119, 120, 252, 262, 265, 279, 281, 399/286
See application file for complete search history.

(56) References Cited

U.S. PATENT DOCUMENTS 5,333,040 A 7/1994 Imamiya
5,621,505 A * 4/1997 Kobayashi et al. ..... 399/274
6,668,148 B2 * 12/2003 Hirano et al. ..... 399/284

FOREIGN PATENT DOCUMENTS

| | | |
|---|---|---|
| JP | 63-085652 | 4/1988 |
| JP | 04-050979 | 2/1992 |
| JP | 05-061299 | 3/1993 |
| JP | 05-088536 | 4/1993 |
| JP | 06-318013 | 11/1994 |
| JP | 07-333969 | 12/1995 |
| JP | 08-202143 | 8/1996 |
| JP | 11-249428 | 9/1999 |
| JP | 2004-118121 | 4/2004 |

* cited by examiner

*Primary Examiner*—Hoan Tran
(74) *Attorney, Agent, or Firm*—Banner & Witcoff, Ltd

(57) ABSTRACT

A developer unit according to one aspect of the invention includes: a developer accommodation member configured to accommodate a developer, the developer having charging polarity to a first polarity; a developing roller arranged at the developer accommodation member, the developing roller being configured to carry the developer; a supply roller arranged at the developer accommodation member, the supply roller being configured to supply the developer to the developing roller; and a charging member brought into sliding contact with the supply roller. The charging member at a portion brought into sliding contact with the supply roller is formed of a material which is positioned on a side of the first polarity on a triboelectric series relative to the supply roller.

11 Claims, 11 Drawing Sheets

DEVELOPER UNIT, PROCESS DEVICE AND IMAGE FORMING APPARATUS

CROSS-REFERENCE TO RELATED APPLICATIONS

This application is based upon and claims the benefit of priority from Japanese Patent Application No. 2007-173515, filed on Jun. 29, 2007, the entire contents of which are incorporated herein by reference.

TECHNICAL FIELD

One aspect of the present invention relates to a developer unit, a process device and an image forming apparatus.

BACKGROUND

A developer device (developer unit) capable of accommodating a developer therein is disposed in an electrophotographic type image forming apparatus such as a laser printer or a digital multi function device. Then, the developer accommodated in the developer device is supplied to a developing roller through a supply roller and is further supplied from the developing roller to an image carrier on which an electrostatic latent image is formed, and thereafter is transferred to a recording sheet.

Since a developer is generally a consumable article, it is necessary to replace a developer cartridge detachable from the developer device body or directly supply a new developer to the inside of the developer device after the developer is used up.

When the new developer is supplied, a deteriorated developer remaining in the developer device is mixed with the new developer in the developer device. At this time, an electric charge moves between the new developer and the deteriorated developer, and the new developer is charged in a polarity to be properly charged, and the deteriorated developer is charged in a polarity opposite to the polarity to be properly charged. Consequently, the new developer and the deteriorated developer aggregate electrostatically and an aggregate is generated. When this aggregate or the oppositely charged developer (developer charged in the polarity opposite to the polarity to be properly charged) is supplied from the supply roller to the image carrier through the developing roller, for example, the developer is transferred to the portion other than an image to be formed, and image quality may reduce.

JP-A-8-202143 discloses a developer device including a conductive developing chamber and a supply roller made of a foamable material, and the bottom portion of the conductive developing chamber is arranged to oppose to the supply roller with an interval of, for example, 1 mm. A bias applied to the bottom portion of the developing chamber is a bias that deviates to the same polarity side as a charging polarity of a developer than a bias applied to the supply roller. According to the developer device, an oppositely charged developer adhering to the supply roller is adsorbed to the bottom portion of the developing chamber. As a result, an influence of an aggregate or the oppositely charged developer on image formation can be suppressed.

Incidentally, a supply roller supplies a developer to a developing roller, so that it is particularly desirable to surely remove an oppositely charged developer adhering to the supply roller.

However, the developer device described above provides a relatively large gap (for example, 1 mm) between the supply roller and the bottom portion of the developing chamber, and a developer is introduced in the gap. Therefore, it is difficult to surely adsorb the oppositely charged developer adhering to the supply roller to the bottom portion of the developing chamber. As a result, in the developer device, the oppositely charged developer remaining on the supply roller may be supplied to an image carrier through the developing roller and transferred to a recording sheet. Therefore, a reduction in image quality cannot be suppressed surely.

SUMMARY

An object of one aspect of the invention is to provide a developer unit, a process device and an image forming apparatus capable of improving image quality by surely adsorbing an oppositely charged developer.

According to a first aspect of the invention, there is provided a developer unit comprising: a developer accommodation member configured to accommodate a developer, the developer having charging polarity to a first polarity; a developing roller arranged at the developer accommodation member, the developing roller being configured to carry the developer; a supply roller arranged at the developer accommodation member, the supply roller being configured to supply the developer to the developing roller; and a charging member brought into sliding contact with the supply roller, wherein the charging member at a portion brought into sliding contact with the supply roller is formed of a material which is positioned on a side of the first polarity on a triboelectric series relative to the supply roller.

According to a second aspect of the invention, there is provided a process device comprising: a developer unit, the developer unit which comprises: a developer accommodation member configured to accommodate a developer, the developer having charging polarity to a first polarity; a developing roller arranged at the developer accommodation member, the developing roller being configured to carry the developer; a supply roller arranged at the developer accommodation member, the supply roller being configured to supply the developer to the developing roller; and a charging member brought into sliding contact with the supply roller, wherein the charging member at a portion brought into sliding contact with the supply roller is formed of a material which is positioned on a side of the first polarity on a triboelectric series relative to the supply roller; and an image carrier on which the developer is supplied from the developer unit and a developer image is formed.

According to a third aspect of the invention, there is provided an image forming apparatus capable of forming an image on a recording sheet, the image forming apparatus comprising: a process device comprising a developer unit and an image carrier on which a developer is supplied from the developer unit and a developer image is formed, the developer unit comprising: a developer accommodation member configured to accommodate the developer, the developer having charging polarity to a first polarity; a developing roller arranged at the developer accommodation member, the developing roller being configured to carry the developer; a supply roller arranged at the developer accommodation member, the supply roller being configured to supply the developer to the developing roller; and a charging member brought into sliding contact with the supply roller, wherein the charging member at a portion brought into sliding contact with the supply roller is formed of a material which is positioned on a side of the first polarity on a triboelectric series relative to the supply roller; an exposure device configured to expose the image carrier of the process device and form an electrostatic latent image on the image carrier; a transfer device configured to transfer a developer image formed by the process device to the recording sheet; and a fixing device configured to fix an image formed on the recording sheet.

BRIEF DESCRIPTION OF THE DRAWINGS

FIG. 9A is a print result of the first sheet of the printing, FIG. 9B is a print result of the fifth sheet of the printing and FIG. 9C is a print result of the tenth sheet of the printing;

FIG. 10A is a print result of the first sheet of the printing, FIG. 10B is a print result of the fifth sheet of the printing, and FIG. 10C is a print result of the tenth sheet of the printing.

DESCRIPTION

First Embodiment

Figure 1:
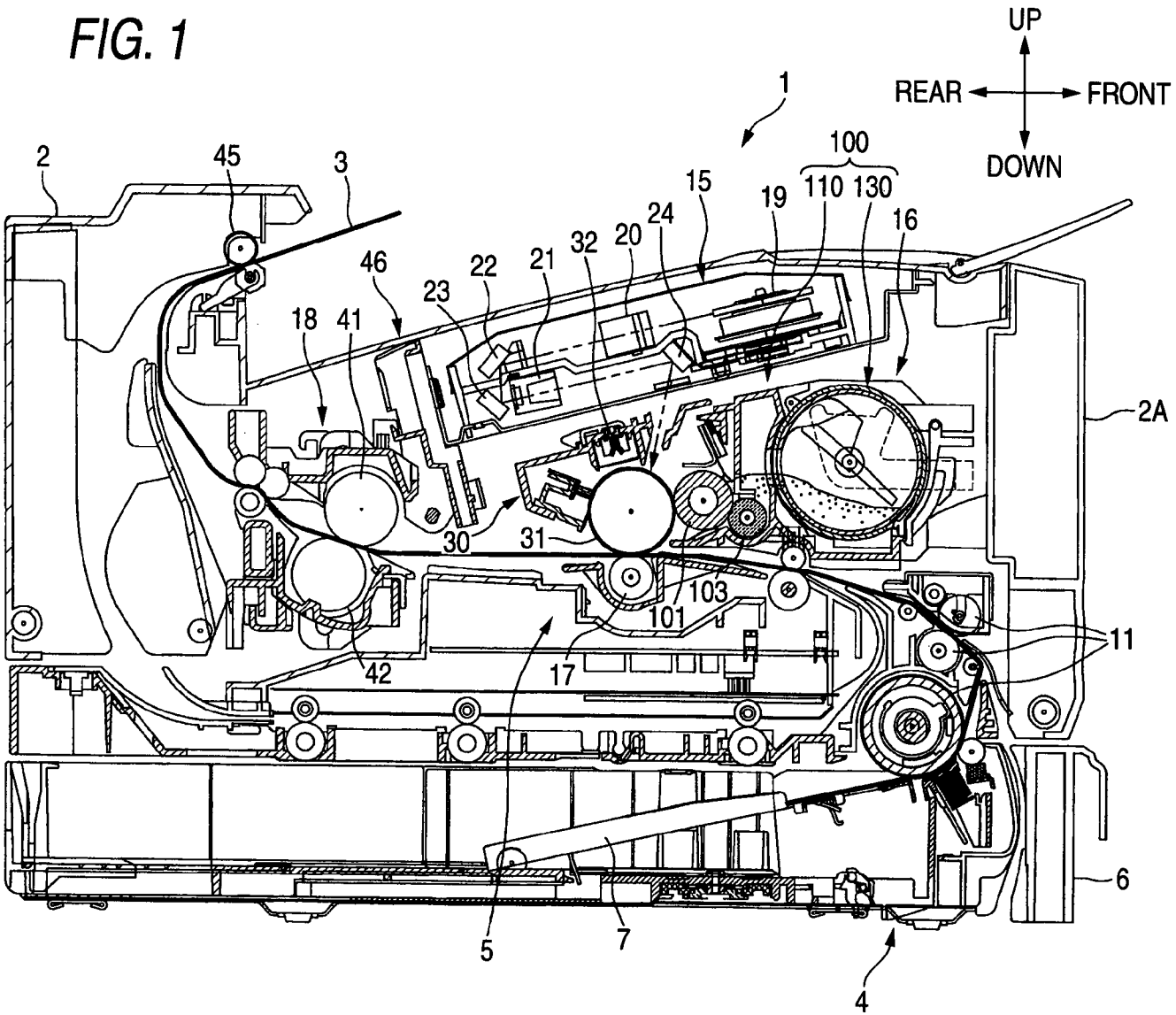
FIG. 1 is a side cross-sectional view showing a laser printer as one example of an image forming apparatus according to a first embodiment of the invention.
Figure 2:
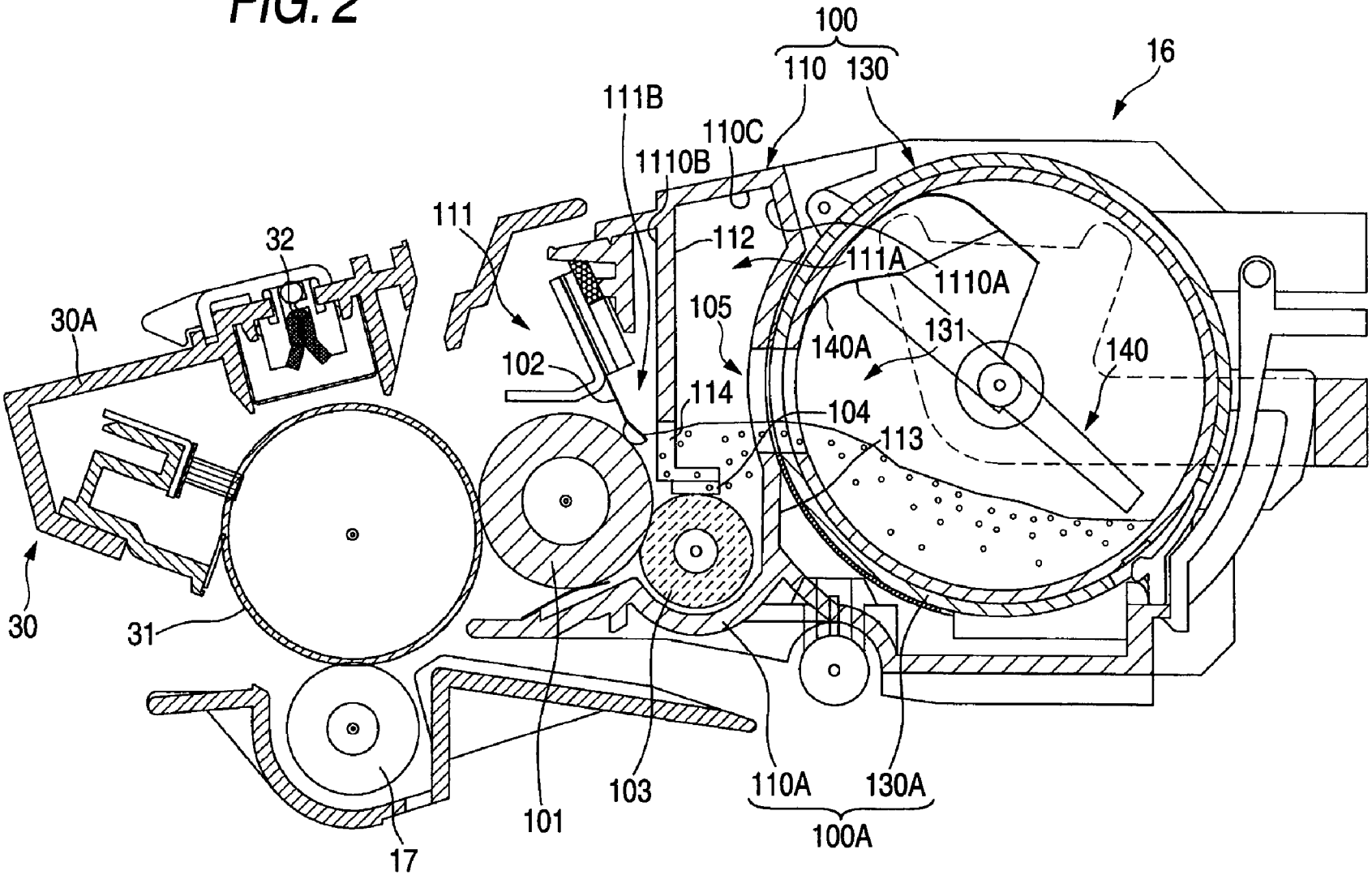
FIG. 2 is a side cross-sectional view showing a process device in FIG. 1.
Figure 11:
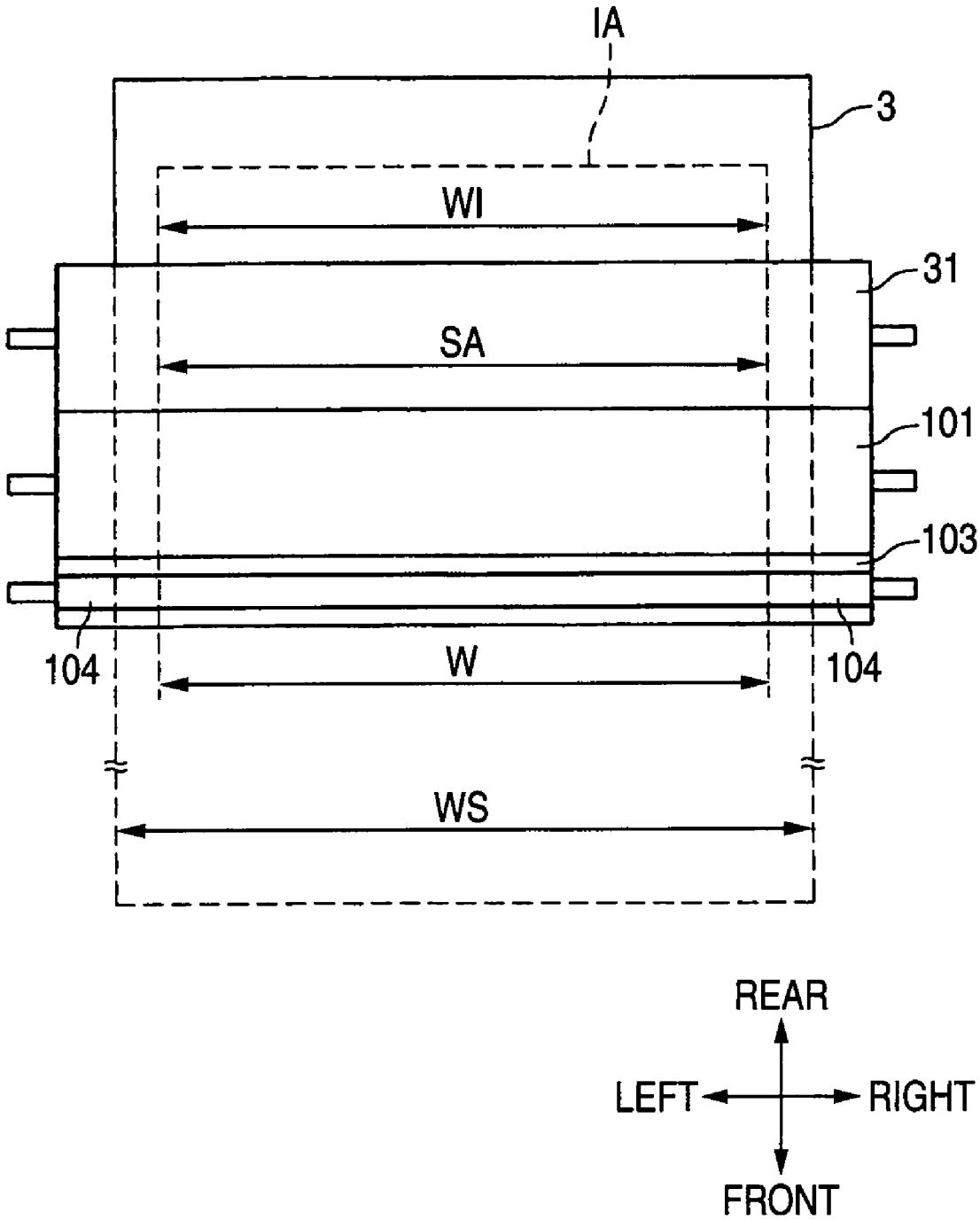
FIG. 11 is a schematic view describing an image formation width of a supply roller.

Next, a first embodiment of the invention will be described in detail with reference to the drawings. In the reference drawings, FIG. 1 is a side cross-sectional view showing a laser printer as one example of an image forming apparatus, and FIG. 2 is a side cross-sectional view showing a process device. FIG. 11 is a schematic view describing an image formation width of a supply roller. In addition, in the following description, directions are described with reference to a user at the time of using the laser printer. That is, in FIG. 1, the right side of a paper surface is referred to as the "front side," the left side is referred to as the "rear side," the rear side of a vertical direction of the paper surface is referred to as the "right side," and the front side is referred to as the "left side". In addition, upper and lower directions are referred to as "upper and lower directions" since directions of the user at the time of using the laser printer match with the illustrated directions.

<The Whole Configuration of Laser Printer>

As shown in FIG. 1, a laser printer 1 as one example of an image forming apparatus includes a feeder 4 configured to feed a sheet 3 as one example of a recording sheet, and an image forming unit 5 configured to form an image on the sheet 3, which are disposed in a body casing 2.

<Configuration of Feeder>

The feeder 4 mainly includes a sheet feeding tray 6 detachably attached to a bottom portion of the inside of the body casing 2, and a sheet press plate 7 disposed in the sheet feeding tray 6. Also, the feeder 4 includes various rollers 11 configured to perform sheet powder removal or transport of the sheet 3.

In the feeder 4, the sheet 3 in the sheet feeding tray 6 is pulled upward by the sheet press plate 7 and is conveyed to the image forming unit 5 by various rollers 11.

<Configuration of Image Forming Unit>

The image forming unit 5 includes a scanner unit 15 as one example of an exposure device, a process device 16, a fixing unit 18 as one example of a fixing device.

<Configuration of Scanner Unit>

The scanner unit 15 is disposed in an upper portion of the body casing 2, and includes a laser light emitting unit (not shown), a polygon mirror 19 capable of being rotation driven, lenses 20, 21, reflecting mirrors 22, 23, 24. As shown by a chain line, a laser beam based on image data emitted from the laser light emitting unit is reflected or passed in order of the polygon mirror 19, the lens 20, the reflecting mirror 22, the reflecting mirror 23, the lens 21 and the reflecting mirror 24, and a surface of a photoconductive drum 31 as one example of an image carrier of the process device 16 is irradiated with the laser beam by high-speed scanning.

<Configuration of Process Device>

The process device 16 is detachably attached to the body casing 2 by opening a front cover 2A disposed on the front side of the body casing 2. This process device 16 is mainly includes a developer unit 100 and a drum unit 30.

The developer unit 100 is detachably attached to the body casing 2 through the drum unit 30, more specifically, is detachably attached to the drum unit 30 fixed inside the body casing 2. When the developer unit 100 is attached to the body casing 2, only the developer unit 100 may be attached to the body casing 2, or the process device 16 in which the drum unit 30 is attached to the developer unit 100 may be attached to the body casing 2.

The developer unit 100 includes a developing cartridge 110 and a toner cartridge 130.

As shown in FIG. 2, the developing cartridge 110 mainly includes: a developing case 110A that defines a developing chamber 111; a developing roller 101; a layer thickness regulating blade 102; a supply roller 103 that is brought into sliding contact with the developing roller 101; and a charging member 104 that is brought into sliding contact with the supply roller 103. The developing roller 101 and the supply roller 103 are positively biased at the time of development.

Here, as shown in FIG. 11, the "image formation width W" refers to the portion corresponding to a width WI along right and left directions of an image formation region IA on the sheet 3 in which the width is maximum in the sheet used in the laser printer 1, of the whole width of an axis direction (right and left directions) of the supply roller 103. In addition, the width WI along the right and left directions of the image formation region IA is equal to a laser beam scanning range SA of the surface of the photoconductive drum 31, so that the image formation width W is also equal to the laser beam scanning range SA of the surface of the photoconductive drum 31. In FIG. 11, the charging member 104 extends in the axis direction to contact with the entire width of the supply roller 103. However, the charging member 104 may extend in the axis direction to contact with at least the image formation width W of the supply roller 103.

Figure 4:
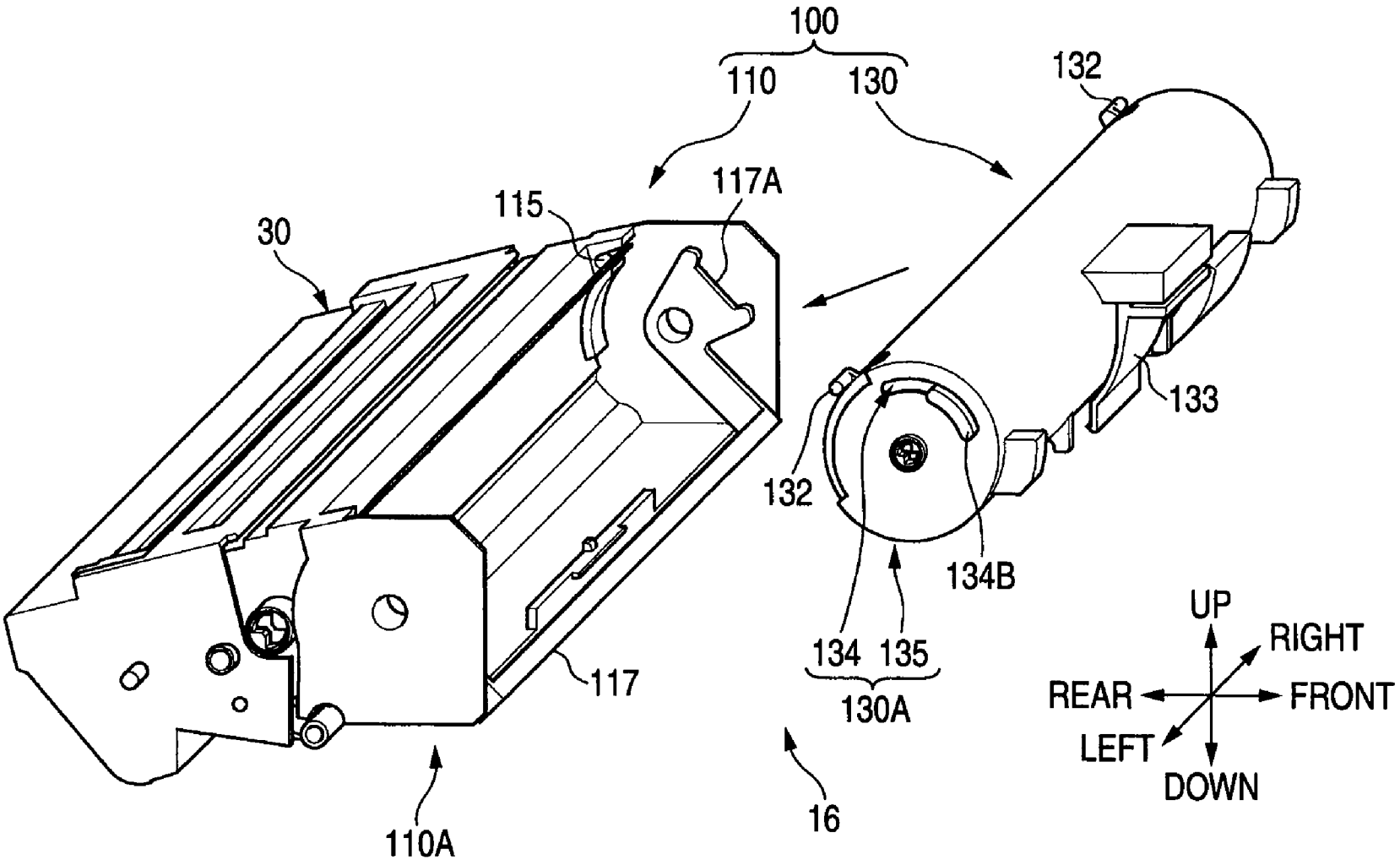
FIG. 4 is a perspective view showing a developing cartridge and a toner cartridge.

As shown in FIG. 2, the toner cartridge 130 includes a toner case 130A as one example of a developer case which defines a developer accommodation chamber 131 and an agitator 140 configured to transport the toner accommodated in the developer accommodation chamber 131 to the developing chamber 111, and is detachable from the developing case 110A (see FIG. 4). The developer accommodation chamber 131 is, more concretely, space and is defined by a wall surface (inner wall surface) of the toner cartridge 130.

In the embodiment, a developer accommodation member 100A, which is configured as a casing of the developer unit 100, includes the developing case 110A and the toner case 130A. Then, the developer accommodation member 100A with the toner case 130A attached to the developing case 110A can be attached to and detached from the body casing 2.

Toner as one example of a developer accommodated in the developer accommodation chamber 131 is supplied to from the developer accommodation chamber 131 to the inside of the developing chamber 111 and thereafter is supplied to the developing roller 101 directly or through the supply roller 103. With rotation of the developing roller 101, the toner supplied to the developing roller 101 enters between the layer thickness regulating blade 102 and the developing roller 101 and is carried on the developing roller 101 as a thin layer with a predetermined thickness. At this time, the toner is positively charged by friction due to the sliding contact between the supply roller 103 and the developing roller 101 or the sliding contact between the layer thickness regulating blade 102 and the developing roller 101.

As shown in FIG. 2, the drum unit 30 mainly includes the photoconductive drum 31 as one example of the image carrier, a scorotron charging device 32, and a transfer roller 17 as one example of a transfer device.

The photoconductive drum 31 is rotatably supported in a drum case 30A and is arranged to be brought into contact with the developing roller 101 in the rear side of the developing roller 101 in a state where the developer unit 100 is attached to the drum unit 30.

The scorotron charging device 32 is a scorotron type charging device for positive charging configured to generate a corona discharge from a wire for charging such as tungsten, and is configured to uniformly charge a surface of the photoconductive drum 31 in positive polarity.

The transfer roller 17 is rotatably supported in the drum case 30A and is arranged under the photoconductive drum 31 to oppose to and contact with the photoconductive drum 31. A transfer bias is applied to this transfer roller 17 by constant-current control at the time of transfer.

In the process device 16, the surface of the photoconductive drum 31 is positively charged uniformly by the scorotron charging device 32 and thereafter is exposed by high-speed scanning of a laser beam from the scanner unit 15. Consequently, a potential of the exposed portion falls and an electrostatic latent image based on image data is formed.

Here, the "electrostatic latent image" refers to the exposed portion which is a portion of the surface of the photoconductive drum 31 being uniformly and positively charged, but potential of the exposed portion falls due to exposure by the laser beam.

Then, by rotation of the developing roller 101, the toner carried on the developing roller 101 is supplied to the electrostatic latent image formed on the surface of the photoconductive drum 31 when the toner is opposed to and is brought into contact with the photoconductive drum 31. Thus, the toner is selectively carried on the surface of the photoconductive drum 31 to allow a visible image to be obtained, and a toner image is formed by reversal development.

Thereafter, the photoconductive drum 31 and the transfer roller 17 are rotated and driven such that the sheet 3 is conveyed in a state where the sheet 3 is pinched between the photoconductive drum 31 and the transfer roller 17, and thereby the toner image carried on the surface of the photoconductive drum 31 is transferred to the sheet 3.

<Configuration of Fixing Unit>

As shown in FIG. 1, the fixing unit 18 is disposed on the downstream side of the process device 16, and mainly includes a heating roller 41, and a press roller 42 which is arranged to oppose to the heating roller 41 and presses the heating roller 41.

In the fixing unit 18, the toner transferred to the sheet 3 is thermally fixed while the sheet 3 passes between the heating roller 41 and the press roller 42. The sheet 3 on which the toner is thermally fixed in the fixing unit 18 is conveyed by a sheet delivery roller 45 disposed on the downstream side of the fixing unit 18 and is delivered to a sheet delivery tray 46.

<Detailed Structure of Developer Unit>

Figure 3:
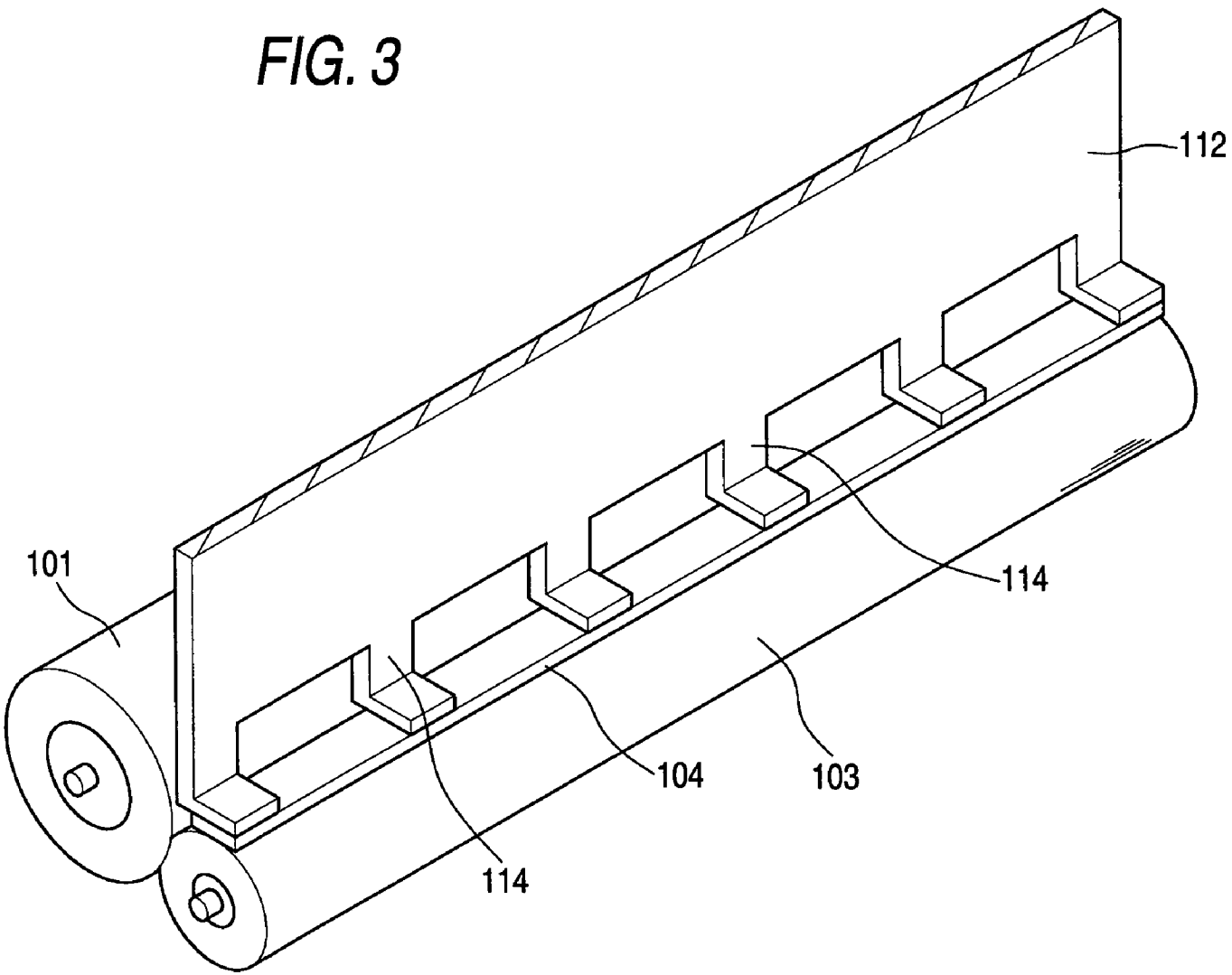
FIG. 3 is a perspective view showing a relation between a fixing member and a charging member.

Next, a detailed structure of the developer unit 100 according to the first embodiment of the invention will be described. FIG. 3 is a perspective view showing a relation between a fixing member and a charging member.

As described above, the developer accommodation member 100A as the casing of the developer unit 100 is formed by the developing case 110A and the toner case 130A.

As shown in FIG. 2, the developing case 110A rotatably supports the developing roller 101 and the supply roller 103 and also, defines the developing chamber 111 in which the developing roller 101, the layer thickness regulating blade 102, the supply roller 103 and the charging member 104 are arranged.

A partition wall 112 is provided at the inside of an upper wall of the developing case 110A and positioned above the supply roller 103. The partition wall 112 extends from an upper portion toward a lower portion and is arranged so as to divide the developing chamber 111 into two portions. For convenience of description, the front side, that is, one portion, of the two portions of the developing chamber 111 divided by the partition wall 112, in which toner is accumulated is called a first developing chamber 111A, and the rear side, that is, the other portion in which the developing roller 101 and the layer thickness regulating blade 102 are arranged is called a second developing chamber 111B.

More concretely, the first developing chamber 111A is space and is defined by a wall surface (inner wall surface) 1110A of the developing case 110A. Also, the second developing chamber 111B is space and is defined by a wall surface (inner wall surface) 1110B of the developing case 110A.

A demarcation wall 113 as one example of a demarcation portion that is a part of the developing case 110A and also demarcates the developing chamber 111 from the toner case 130A (developer accommodation chamber 131) described below is formed in the front side of the developing case 110A.

The charging member 104 is disposed on an upper side of the supply roller 103 so as to be sliding contact with the supply roller 103. As shown in FIG. 3, the charging member 104 is fixed to a plurality of fixing members 114 formed at a lower portion of the partition wall 112. Since the plurality of fixing members 114 are disposed with constant intervals, toner is supplied to the developing roller 101 through gaps formed between adjacent fixing members 114.

A surface of the supply roller 103 of the embodiment is formed of a urethane foamed elastic body. On the other hand, the charging member 104 is formed of an acrylic plate which is a material whose position on the triboelectric series is positioned to the positive polarity side relative to the surface material of the supply roller 103, that is, urethane. That is, the charging member 104 has a stronger tendency to be charged to the positive polarity side than the supply roller 103. Consequently, when the supply roller 103 rotates and is brought into sliding contact with the charging members 104, a portion of the supply roller 103 which is brought into sliding contact with the charging member 104 is positively charged by friction.

Here, the "triboelectric series" refers to sequence in which when friction (sliding contact) between two kinds of materials is produced, the material having a tendency to be charged to the positive polarity side is arranged to the high-order side (positive polarity side) and the material having a tendency to be charged to the negative polarity side is arranged to the low-order side (negative polarity side).

The toner case 130A forms the developer accommodation chamber 131 in which toner is accommodated, and the developer accommodation chamber 131 communicates with the first developing chamber 111A (developing chamber 111) through the opening 105. Also, the toner case 130A is detachable from the developing case 110A as described above, so that toner supply can be facilitated and handling of the developer unit 100 is facilitated.

One example of an attachment and detachment mechanism of the developing case 110A (developing cartridge 110) and the toner case 130A (toner cartridge 130) will herein be described. FIG. 4 is a perspective view showing a developing cartridge and a toner cartridge, FIG. 5A is a side cross-sectional view showing a state of attaching the toner cartridge to the developing cartridge, and FIG. 5B is a side cross-sectional view showing a state where a developing chamber is brought into communication with a developer accommodation chamber.

When the toner case 130A is attached to the developing case 110A, the toner case 130A is pushed toward the front side portion of the developing case 110A while positioning pins 132 of the toner case 130A are aligned with positioning recess portions 115 of the developing case 110A as shown in FIG. 4. At this time, the toner case 130A is fixed to the developing case 110A by hooking an engaging claw 133A of a lever 133 for fixing of the toner case 130A to an engaged portion 116 of the developing case 110A as shown in FIG. 5A. Also, when the toner case 130A is detached from the developing case 110A, the engaging claw 133A is unhooked by pulling up the lever 133 for fixing and the toner case 130A is pulled to an oblique upper portion of the front side of the developing case 110A.

Here, the toner case 130A includes a cylindrical inside casing 134 and an outside casing 135 that rotatably supports the inside casing 134. An inside opening 134A is formed at the inside casing 134, and an outside opening 135A is formed at the outside casing 135, respectively, as shown in FIG. 5A. In a state where the toner case 130A is in a single state (that is, the toner cartridge 130) or a state where the toner case 130A is merely fixed to the developing case 110A (see FIG. 5A), the inside opening 134A does not communicate with the outside opening 135A.

Figure 5A:
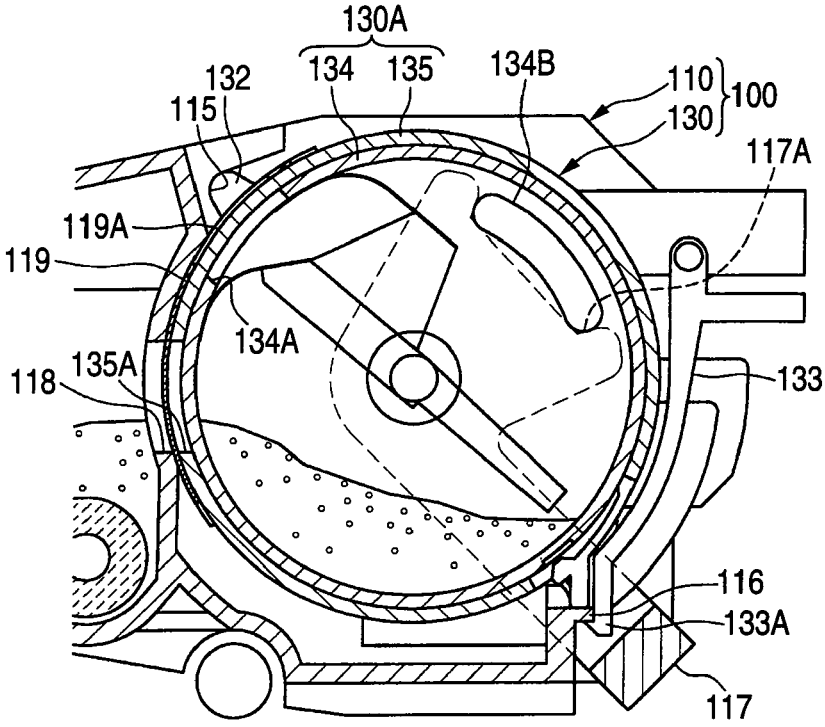
FIG. 5A is a side cross-sectional view showing a state of attaching the toner cartridge to the developing cartridge.
Figure 5B:
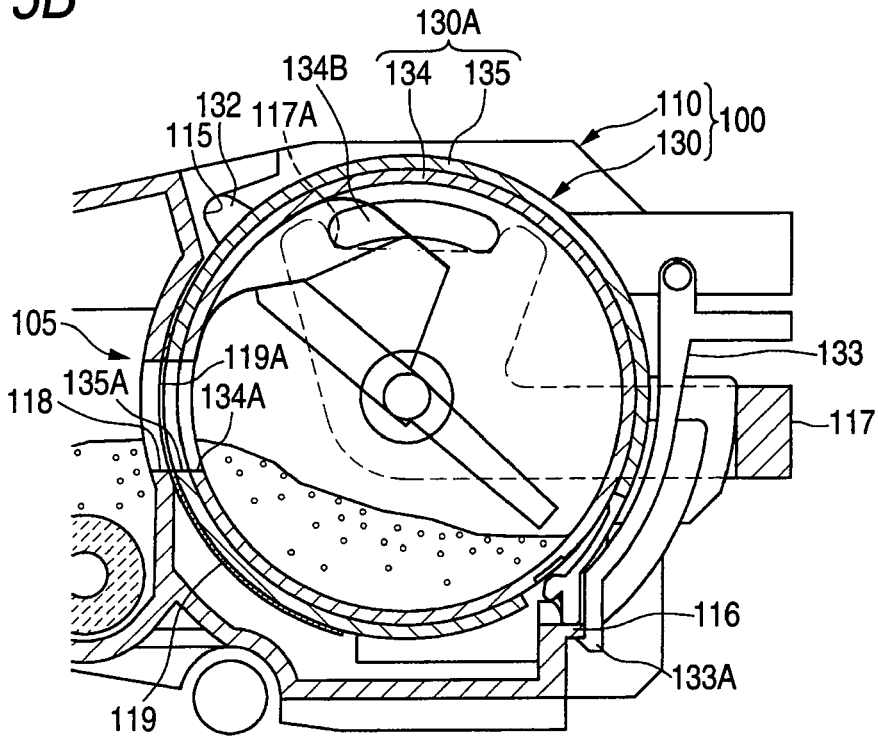
FIG. 5B is a side cross-sectional view showing a state in which a developing chamber communicates to a developer accommodation chamber.

When the toner case 130A is fixed to the developing case 110A, circular arc protrusions 134B (see FIG. 4) formed on both ends of the inside casing 134 fit into recess portions 117A of operation levers 117 swingably disposed in the developing case 110A as shown in FIG. 5A. Then, communication between the inside opening 134A and the outside opening 135A is allowed by upward swinging the operation levers 117 and turning the inside casing 134 with respect to the outside casing 135 as shown in FIG. 5B.

A shutter 119 configured to open and close a toner supply port 118 disposed in the developing case 110A is provided so as to turn integrally with the inside casing 134 by engaging with an engaging portion (not shown) of the inside casing 134 simultaneously at this time. Consequently, by upward swinging the operation lever 117, communication among the toner supply port 118, a shutter opening 119A, the outside opening 135A and the inside opening 134A is allowed, and the opening 105 is formed.

In addition, the front side of the toner case 130A is also fixed by this operation lever 117 in a state shown in FIG. 5B.

Figure 6:
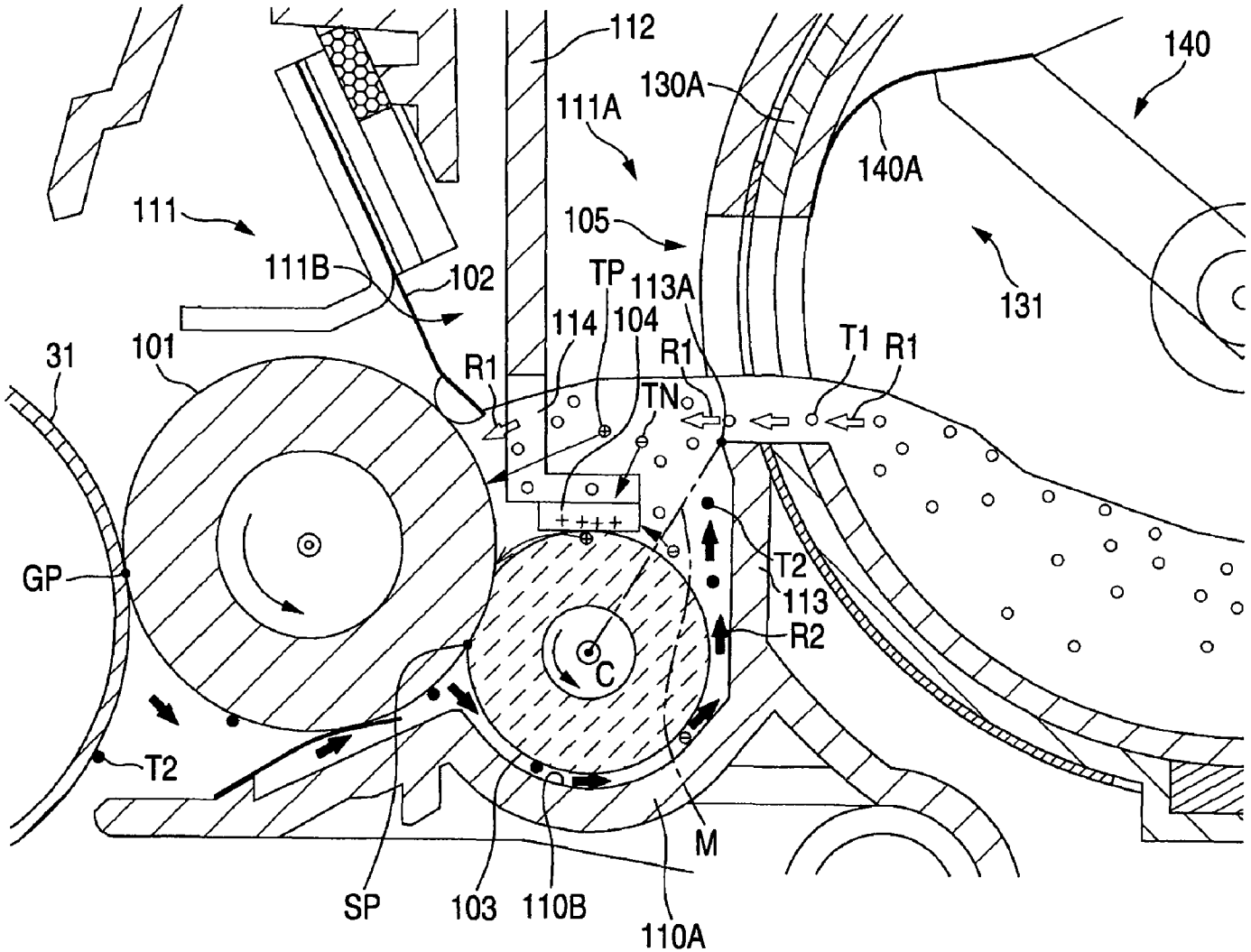
FIG. 6 is an enlarged cross-sectional view describing operation of a charging member.

Next, operation of the charging member 104 of the developer unit 100 as described above will be described. FIG. 6 is an enlarged cross-sectional view describing the operation of the charging member.

The developing case 110A has a first opposed wall 110B as shown in FIG. 6. The first opposed wall 110B is opposed to a region on a surface of the developing roller 101 extending from a development position GP and continued toward a downstream side of a rotation direction of the developing roller 101 to a position SP where the developing roller 101 contacts with the supply roller 103, and a region on a surface of the supply roller 103 extending from the position SP where the supply roller 103 contacts with the developing roller 101 and continued toward the downstream side of a rotation direction of the supply roller 103.

Here, the "development position GP" refers to a position on the surface of the developing roller 101 nearest to the photoconductive drum 31, and particularly in the embodiment, refers to a position on the surface of the developing roller 101 in contact with the photoconductive drum 31.

Also, the developing case 110A has a second opposed wall 110C (see FIG. 2) disposed on the opposite side of the first opposed wall 110B with respect to the supply roller 103.

The demarcation wall 113 described above continuously extends from the first opposed wall 110B toward the downstream side (toward the side of the second opposed wall 110C) of the rotational direction of the supply roller 103 and thereby, demarcates the developer accommodation chamber 131 from the first developing chamber 111A. More specifically, the demarcation wall 113 is formed between the developer accommodation chamber 131 and the first developing chamber 111A, and the upper end (top) of the demarcation wall 113 forms a part of the opening 105.

Here, a toner collection path R2 is defined in this embodiment to include: a path formed between the first opposed wall 110B and the developing roller 101 and the supply roller 103; and a path formed between the supply roller 103 and the demarcation wall 113. In the toner collection path R2, deteriorated toner T2 is collected from the photoconductive drum 31 to the inside of the first developing chamber 111A through the developing roller 101 and the supply roller 103. Also, a toner supply path R1 is defined in this embodiment to include: a path in which new toner T1 moves from the developer accommodation chamber 131 to a merging portion M described below through the opening 105; and a path in which the toner T1 is supplied from the merging portion M through the developing roller 101 to the photoconductive drum 31. The toner supply path R1 is formed in the side opposite to the first opposed wall 110B with respect to the supply roller 103 in the downstream side from the merging portion M.

Further, the merging portion M in this embodiment is defined by a region between a surface of the supply roller 103 and a rear side upper end 113A on a line (plane) connecting the rotational center C of the supply roller 103 to the rear side upper end 113A of the demarcation wall 113, that is, a region in which the toner supply path R1 and the toner collection path R2 merge.

The toner of the embodiment is nonmagnetic without including magnetic particles, one-component, positively chargeable, and polymerization toner. Since the toner is brought into sliding contact between the supply roller 103 and the developing roller 101 or between the layer thickness regulating blade 102 and the developing roller 101 or between the developing roller 101 and the photoconductive drum 31 while the toner is frictionally charged and supplied from the supply roller 103 to the developing roller 101 and the photoconductive drum 31, the toner tends to deteriorate and becomes resistant to charge to the positive polarity side. Thus, the toner deteriorates and results in the deteriorated toner T2.

Since the deteriorated toner T2 is collected to the inside of the first developing chamber 111A through the toner collection path R2, the toner T2 remains inside the developing chamber 111. When the toner cartridge 130 is replaced in this state and then new toner T1 is supplied to the inside of the first developing chamber 111A through the toner supply path R1, the new toner T1 is mixed with the deteriorated toner T2 in the vicinity of the merging portion M. When the new toner T1 is mixed with the deteriorated toner T2, by friction of the mutual toners, the new toner T1 is positively charged and becomes positively charged toner TP, and the deteriorated toner T2 is negatively charged and becomes oppositely charged toner (toner charged in negative polarity opposite to positive polarity to be properly charged) TN.

When image forming is started in a state where the toners T1, T2, TN, TP described above are present as shown in FIG. 6, the agitator 140 rotates in a clockwise direction, and the developing roller 101 and the supply roller 103 are driven to rotate in a counterclockwise direction (arrow direction of FIG. 6). Then, an agitating blade (film) 140A disposed at the distal end of the agitator 140 transports toner to the developing chamber 111 through the opening 105. Then, by rotation of the supply roller 103, a surface of the supply roller 103 formed of a urethane foamed elastic body is brought into sliding contact with the charging member 104 formed of an acrylic plate, and a portion where the supply roller 103 is brought into sliding contact with the charging member 104 is positively charged by friction.

Consequently, the oppositely charged toner TN remaining in the first developing chamber 111A or the oppositely charged toner TN collected through the toner collection path R2 and adhering to the supply roller 103 is adsorbed by electrostatic force to the charging member 104 which is positively charged. By adsorbing the oppositely charged toner TN to the charging member 104, the oppositely charged toner TN is separated from the positively charged toner TP, so that occurrence of an aggregate is suppressed.

In addition, the positively charged toner TP is supplied to the developing roller 101 directly or through the supply roller 103 without being adsorbed to the charging member 104 positively charged and is further supplied from the developing roller 101 to the photoconductive drum 31 and thereafter is transferred to the sheet 3, thereby an image is formed.

According to the above, the following effects can be obtained in the embodiment.

The supply roller 103 is brought into sliding contact with the charging member 104, so that the charging member 104 is charged to the positive polarity side, so that the oppositely charged toner TN adhering to the supply roller 103 or present inside the developing case 110A can be adsorbed to the charging member 104. Consequently, the oppositely charged toner TN can be separated, and occurrence of an aggregate in which the oppositely charged toner TN and the positively charged toner TP electrostatically aggregate can be suppressed. As a result, a situation in which the oppositely charged toner TN or the aggregate is supplied to the photoconductive drum 31 through the developing roller 101 is suppressed, and transfer from the photoconductive drum 31 to the sheet 3 is also suppressed. Therefore, the image quality can be improved.

The supply roller 103 is brought into sliding contact with the charging member 104, and a gap between the supply roller 103 and the charging member 104 is small, so that the amount of toner present between the supply roller 103 and the charging member 104 can be decreased and the oppositely charged toner TN adhering to the supply roller 103 can surely be adsorbed to the charging member 104. Consequently, a situation in which the oppositely charged toner TN adhering to the supply roller 103 is supplied to the photoconductive drum 31 through the developing roller 101 is suppressed more surely, and transfer from the photoconductive drum 31 to the sheet 3 is also suppressed. Therefore, the image quality can be more improved.

Since a surface of the supply roller 103 is formed of a foamed elastic body, many recess portions are formed on the surface of the supply roller. Because of this, toner is carried in the recess portions of the surface of the supply roller 103 and also a surface portion other than the recess portions is elastically appropriately deformed and thereby, the supply roller 103 is surely brought into sliding contact with the charging member 104. Consequently, the supply roller 103 can surely transport the toner, and the charging member 104 can surely be charged to the positive polarity side.

Since the developing roller 101 and the supply roller 103 rotate in the same direction (counterclockwise direction), a toner supply path (not shown) from the supply roller 103 to the developing roller 101 is clearly distinguished from the toner collection path R2 extending from the developing roller 101 to the supply roller 103. Consequently, the deteriorated toner T2 or the oppositely charged toner TN smoothly flows through a developing chamber, so that retention of the deteriorated toner T2 or the oppositely charged toner TN can be suppressed, and adsorption of the oppositely charged toner TN by the charging member 104 can be performed more effectively.

Also, the deteriorated toner T2 or the oppositely charged toner TN smoothly flows through the developing chamber, so that a situation in which the deteriorated toner T2 or the oppositely charged toner TN is locally retained is suppressed. As a result of that, a reduction in quality of a formed image due to an increase in a concentration of the deteriorated toner T2 or the oppositely charged toner TN is suppressed.

By arranging the charging member 104 in the downstream side of a rotational direction of the supply roller 103 from the merging portion M of the toner collection path R2 and the toner supply path R1, the oppositely charged toner TN can effectively be adsorbed at a position in the vicinity of the developing roller 101. Consequently, the new toner T1 can effectively be supplied to the developing roller 101.

Second Embodiment

Next, a second embodiment of the invention will be described in detail with reference to the drawings. In the present embodiment, a configuration of a part of the developer unit 100 according to the first embodiment described above, specifically, an arrangement position of the charging member 104 is changed, so that only this respect is described. In the reference drawings, FIG. 7 is an enlarged cross-sectional view showing a main portion of a developer unit according to the embodiment, and FIG. 8 is a plan view showing a relation between a fixing member and a charging member.

Figure 7:
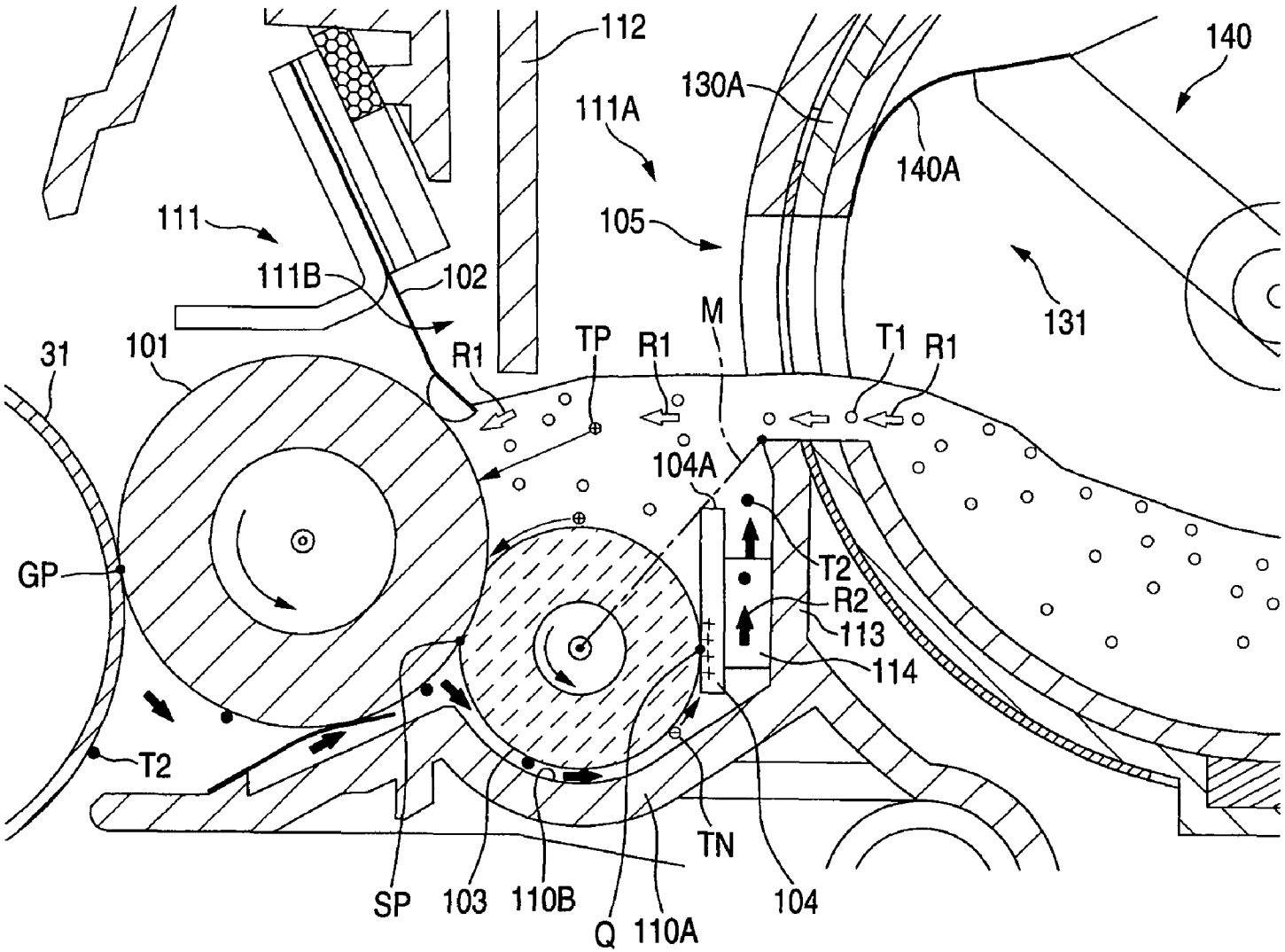
FIG. 7 is an enlarged cross-sectional view showing a main portion of a developer unit according to a second embodiment of the invention.

In the embodiment, as shown in FIG. 7, a charging member 104 is disposed so as to be brought into sliding contact with a supply roller 103 between a demarcation wall 113 and the supply roller 103 on a toner collection path R2. That is, in this embodiment, a developer accommodation chamber 131, the demarcation wall 113, the charging member 104, the supply roller 103 and a developing roller 101 are arranged in this order from the front side to the rear side.

The charging member 104 is configured such that the top end 104A extends from a position Q where the charging member 104 contacting with the supply roller 103 to the downstream side of a rotational direction of the supply roller 103. More specifically, the top end 104A of the charging member 104 matches with a merging portion M.

Figure 8:
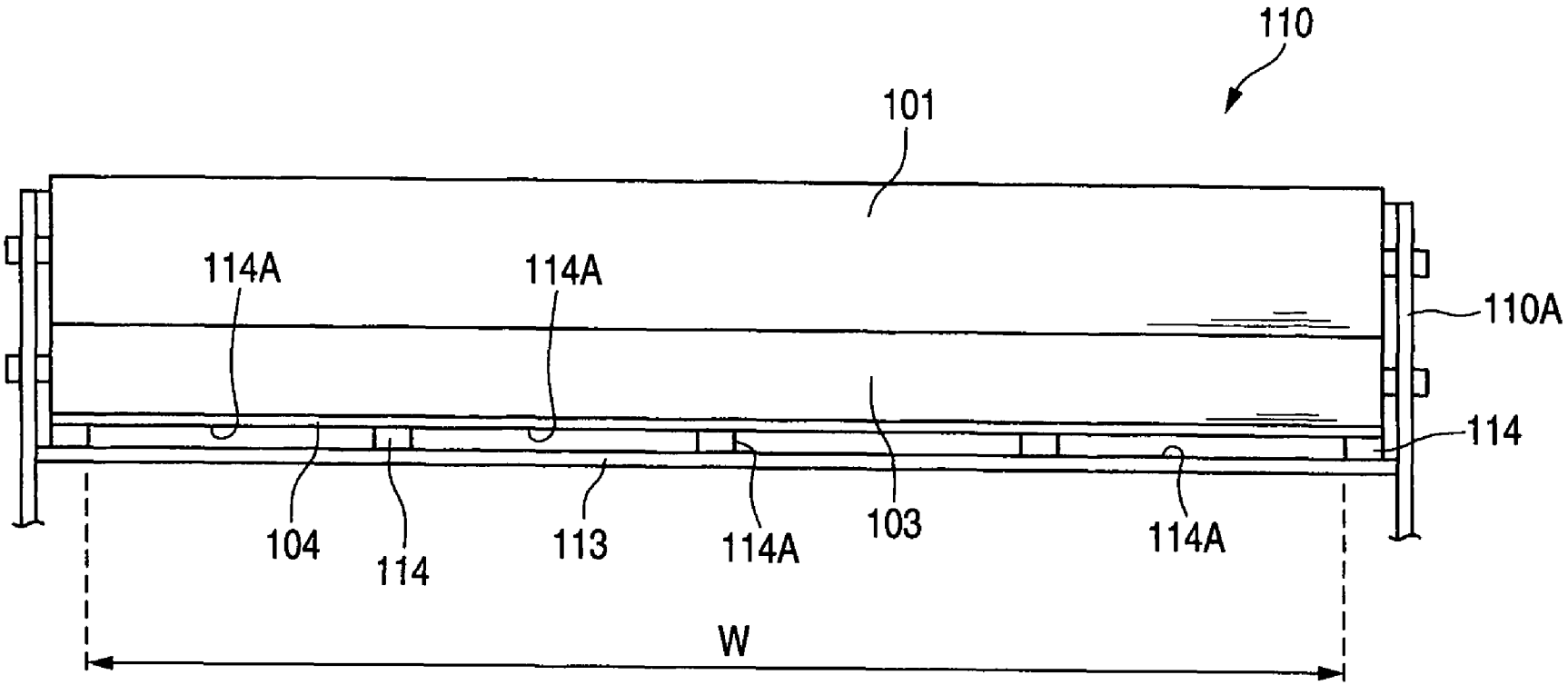
FIG. 8 is a plan view showing a relation between a fixing member and a charging member.

This charging member 104 is fixed to plural fixing members 114 formed in the demarcation wall 113 as shown in FIG. 8. Since the plural fixing members 114 are disposed with constant intervals, toner can pass through gaps 114A formed between adjacent fixing members 114. That is, the gaps 114A for passing the toner toward a toner supply path R1 are formed between adjacent fixing members 114, and the gaps 114A form a part of the toner collection path R2.

Also, the charging member 104 protrudes beyond the fixing members 114 toward the toner supply path R1 side, so that the portion between the charging member 104 and the demarcation wall 113 forms a part of the toner collection path R2.

In FIG. 8, the charging member 104 extends in the axis direction to contact with the entire width of the supply roller 103. However, the charging member 104 may extend in the axis direction to contact with at least the image formation width W of the supply roller 103.

Next, operation of the charging member 104 of a developer unit 100 according to the embodiment will be described briefly.

The developing roller 101 and the supply roller 103 are driven to rotate in the same direction (counterclockwise direction, arrow direction of FIG. 7) when image formation is started in a state where the toners T1, T2, TN, TP described above are present as shown in FIG. 7. Then, by rotation of the supply roller 103, a surface of the supply roller 103 formed of a urethane foamed elastic body is brought into sliding contact with the charging member 104 formed of an acrylic plate, and a portion where the supply roller 103 is brought into sliding contact with the charging member 104 is positively charged by friction.

Consequently, particularly, the oppositely charged toner TN adhering to the supply roller 103 or the oppositely charged toner TN collected through the toner collection path R2 is adsorbed by electrostatic force to the charging member 104 positively charged. By adsorbing the oppositely charged toner TN to the charging member 104, the oppositely charged toner TN is separated from the positively charged toner TP, so that occurrence of an aggregate is suppressed.

According to the developer unit 100 of the embodiment, an effect similar to that of the first embodiment described above can be obtained. Further, in the embodiment, the charging member 104 is arranged on the toner collection path R2 with a high concentration of the deteriorated toner T2 or the oppositely charged toner TN, so that the oppositely charged toner TN can effectively be adsorbed to the charging member 104. Consequently, a concentration of the oppositely charged toner TN of the inside of the first developing chamber 111A can be decreased and occurrence of an aggregate can be suppressed, so that image quality can be improved. Also, the fixing members 114 can be mounted on the demarcation wall 113, so that a surface opposite to the surface in sliding contact between the supply roller 103 and the charging member 104 can be fixed in a more stable state than the first embodiment described above.

Also, the toner collection path R2 is formed between the charging member 104 and the demarcation wall 113 and between adjacent fixing members 114, so that toner which has not passed between the charging member 104 and the supply roller 103 can smoothly be fed to the toner supply path R1. Consequently, a situation in which the deteriorated toner T2 or the oppositely charged toner TN is locally retained and a concentration of the deteriorated toner T2 or the oppositely charged toner TN locally increases is suppressed. As a result of that, image quality can be improved.

Also, the top end 104A of the charging member 104 protrudes beyond the position Q of contact between the charging member 104 and the supply roller 103 toward the toner supply path R1 side, so that the deteriorated toner T2 can smoothly be fed from the toner collection path R2 to the toner supply path R1. Consequently, a situation in which the deteriorated toner T2 is locally retained and a concentration of the deteriorated toner T2 locally increases is suppressed. Further, a situation in which the deteriorated toner T2 passing between the charging member 104 and the demarcation wall 113 directly flows toward a peripheral surface of the supply roller 103 is suppressed. As a result of that, quality of a formed image can be improved.

The embodiments of the invention have been described above, but the invention is not limited to the embodiments described above. A concrete configuration can properly be changed without departing from the scope of the invention.

In the embodiments described above, the sheet 3 such as plain paper, heavy paper, a postcard or thin paper has been illustrated as one example of a recording sheet, but is not limited to this and, for example, an OHP sheet or cloth may be used.

In the embodiments described above, the developer unit 100 is detachably attached to the drum unit 30, but is not limited to this and, for example, the developer unit 100 may be integral with the drum unit 30. Also, the drum unit 30 may be integral with the developing case 110A (developing cartridge 110), and the toner case 130A (toner cartridge 130) may be detachably attached to the drum unit 30 and the developing case 110A.

In the embodiments described above, the whole charging member 104 has been formed of the acrylic plate. However, a positively charged portion on the charging member 104 corresponds to a portion in sliding contact with the supply roller 103. Therefore, the charging member may include the acrylic plate, for example, at least a portion in sliding contact with the supply roller.

In the embodiments described above, the surface of the supply roller 103 is formed of the urethane foamed elastic body, and the charging member 104 is formed of the acrylic plate, but the embodiments are not limited to this. For example, the surface of the supply roller may be formed of iron, and the charging member may be formed of polyester; or the surface of the supply roller may be formed of silicone rubber, and the charging member may be formed of nylon.

In addition, when the surface of the supply roller is formed of silicone rubber which is an elastic body, by elastic deformation of the supply roller, the supply roller appropriately brought into sliding contact with the charging member, and the charging member can well be charged and also toner can be transported between the supply roller and the charging member.

In the embodiments described above, the surface of the supply roller 103 is formed of the foamed elastic body, but is not limited to this. For example, the charging member may be formed of a foamed elastic body. In this case, it goes without saying that the foamed elastic body of which the charging member is formed is present, on the triboelectric series, to the positive polarity side relative to a material forming (at least a surface of) the supply roller. As one example, the supply roller can be formed of polyethylene and the charging member can be formed of polyurethane foam.

In the embodiments described above, the developing roller 101 and the supply roller 103 rotate in the same direction, but are not limited to this, and the developing roller and the supply roller may opposite directions to one another.

In the embodiments described above, one charging member 104 is disposed with respect to the supply roller 103 has been shown, but is not limited to this. A plurality of charging members 104 may be disposed with respect to the supply roller 103. For example, the configurations of the first and second embodiments described above may be combined.

In the embodiments described above, the developer accommodation member 100A is formed of two parts of the developing case 110A and the toner case 130A detachably attached to the developing case 110A, but is not limited to this. For example, a developer accommodation member in which the developing case and the toner case (developer case) are integrally constructed may be used. In addition, in this case, a developer can be made by directly supplying a new developer to a developer accommodation chamber formed by the developer accommodation member.

In the embodiments described above, the positively charged toner is shown as one example of the developer, but is not limited to this. For example, even for negatively charged toner, the invention can be applied. In addition, in this case, the charging member is formed of a material present, on the triboelectric series, to the negative polarity side relative to a material forming (at least a surface of) the supply roller. For example, the surface of the supply roller may be formed of aluminum, and the charging member may be formed of polyethylene foam.

In the second embodiment described above, a part of the toner collection path R2 is formed between adjacent fixing members 114, but is not limited to this. For example, a through hole may be formed in one fixing member and the through hole may be used in a part of the toner collection path R2.

EXAMPLE

Next, an example of the invention will be described. In the present example, print experiments were performed using a laser printer (example) with a charging member and a laser printer (comparative example) without a charging member.

Experimental conditions in the example are similar to those of the second embodiment except for dimensions of the charging member and a fixing member and the number of fixing members and, more specifically, are as follows. In addition, the invention is not limited to the following concrete configurations and the second embodiment.

(1) Toner (a) New Toner

Nonmagnetic, one-component, positively chargeable toner (b) Deteriorated Toner

The deteriorated toner refers to toner remaining in a developer unit (developing chamber) after the print on 12,000 sheets of A4-size plain paper by one developer unit filled with new toner.

(2) Developing Roller

Material: Silicone rubber

Diameter: 20 mm

Width (right and left directions): 236 mm (3) Supply Roller

Material: Urethane

Diameter: 13 mm

Width (right and left directions): 217 mm

Peripheral speed: 145 mm/sec (4) Charging Member (Only Example)

Material: Acrylic plate

Thickness (opposed direction of supply roller and charging member): 1.5 mm

Width (width (axis) direction of supply roller): 30 mm

Length (direction orthogonal to width direction and thickness direction): 10 mm

Arrangement position: Similar to second embodiment. However, the charging member is arranged so as to make sliding contact with only regions of 10 to 40 mm (corresponding to a region X of FIGS. 9A to 9C) and 60 to 90 mm (corresponding to a region Y of FIGS. 9A to 9C) from right of FIG. 9A to 9C of a width (217 mm) of the supply roller.

(5) Fixing Member (Only Example)

Two fixing members are disposed in correspondence with one charging member and one gap is formed between their fixing members.

Shape of gap: Rectangle

Cross-sectional area of gap: 32 $mm^2$

Length (axis direction of supply roller): 16 mm

Width (opposed direction of supply roller and charging member): 2 mm

The "gap" refers to space formed by a charging member, a demarcation wall and two fixing members (see FIG. 8).

The print experiments were performed on the above conditions. Concretely, after 30 g of deteriorating toner was put into a developing chamber; and a developing roller, a supply roller and an agitator were rotated for one minute; and 100 g of new toner was supplied to a developer supply chamber and white solid printing was done. Its result is shown in FIGS. 9A to 9C and 10A to 10C.

Figure 9A:
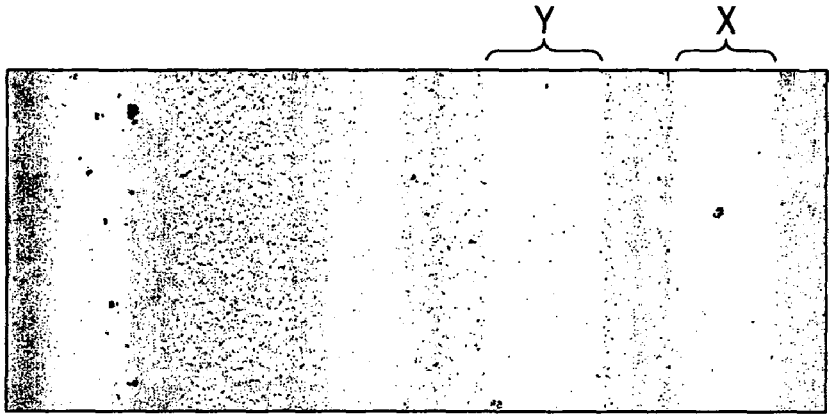
FIGS. 9A to 9C are photographic diagrams showing a part of the sheets after white solid printing is performed using a laser printer with a charging member.
Figure 9B:
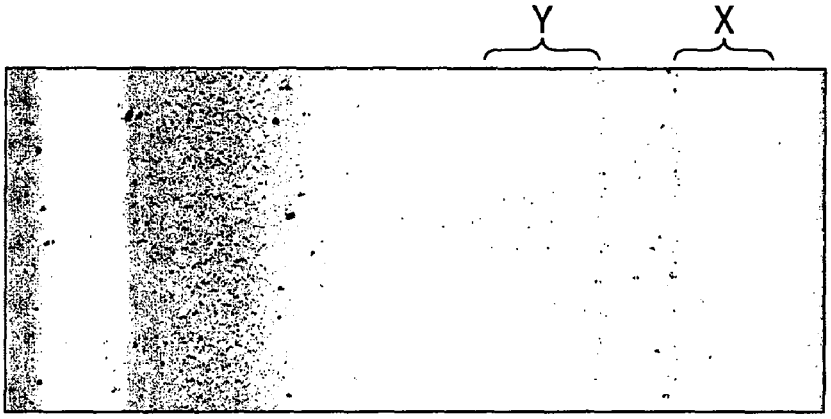
Figure 9C:
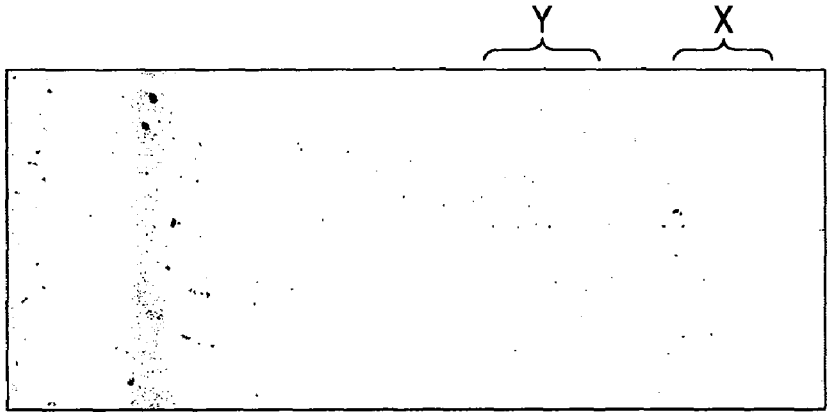
Figure 10A:
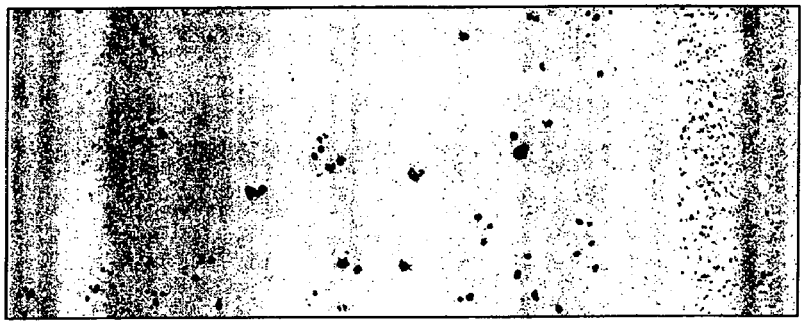
FIGS. 10A to 10C are photographic diagrams showing a part of the sheets after white solid printing is performed using a laser printer without a charging member.
Figure 10B:
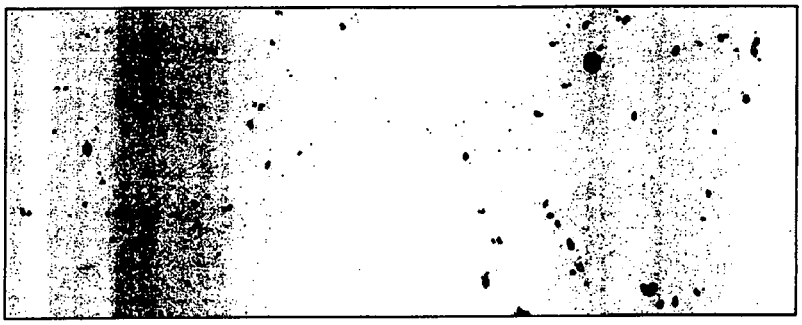
Figure 10C:
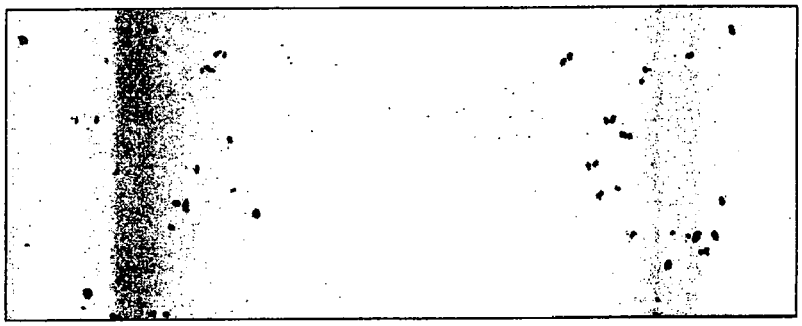

FIGS. 9A to 9C are photographic diagrams each showing a part of the sheets after white solid printing is done using the laser printer of the example. FIGS. 10A to 10C are photographic diagrams each showing a part of the sheets after white solid printing is done using the laser printer of the comparative example, which is a laser printer without the charging member. In addition, FIGS. 9A and 10A are print results of the first sheet of the printing, FIGS. 9B and 10B are print results of the fifth sheet of the printing, and FIGS. 9C and 10C are print results of the tenth sheet of the printing.

Also, in FIGS. 9A to 9C, the regions X and Y of a sheet width direction (axis direction of the supply roller) are a region corresponding to a portion in which the charging member is brought into sliding contact with the supply roller, and the other region is a region corresponding to a portion in which the charging member is not brought into sliding contact with the supply roller.

Here, the "white solid printing" refers to printing performed in a state where an electrostatic latent image is not formed on a photoconductor drum. In addition, in FIGS. 9A to 9C and 10A to 10C, upper and lower directions of a paper surface correspond to a conveying direction of a sheet, and right and left directions of a paper surface correspond to a width direction of a sheet.

An improvement in image quality was found in a region in which the charging member was disposed particularly in the print result of the first sheet of the printing shown in FIG. 9A as a result of performing the white solid printing using the laser printer of the example as shown in FIGS. 9A to 9C. Also, an improvement in image quality was checked found in the periphery of the region in which the charging member was disposed in the print result of the fifth sheet of the printing shown in FIG. 9B. Further, it was found that a region of the improvement in image quality in the print result of the tenth sheet of the printing shown in FIG. 9C became wider than that of the print result of the fifth sheet of the printing.

On the other hand, as a result of performing the white solid printing using the laser printer of the comparative example as shown in FIGS. 10A to 10C, black spots probably due to influence of an aggregate occurred more than those of the example shown in FIGS. 9A to 9C. Also, a size of the black spot in the comparative example was larger than that of the example, and a reduction in image quality was found. In addition, the improvement in image quality by increasing the number of prints was similar to the example, but it was found that its extent was insufficient as compared with the example.

It was found that image quality could be improved more by bringing the charging member having the properties as described above into sliding contact with the supply roller from the above description.

In addition, it was apparent from the experimental results described above that a reduction in image quality due to occurrence of an aggregate became a problem particularly just after (that is, for example, the first sheet of printing than the fifth sheet of printing) toner supply after a toner cartridge is replaced or just after new toner is supplied to the inside of a developer accommodation chamber. Therefore, the charging member described above may be brought into sliding contact with the supply roller for only a predetermined period starting from the supply of a developer to a developer accommodation chamber or from the attachment of a developer case to a developing case, and then may be separated from the supply roller after a lapse of the predetermined time.

What is claimed is:

1. A developer unit comprising:

a developer accommodation member configured to accommodate a developer, the developer having charging polarity to a first polarity;

a developing roller arranged at the developer accommodation member, the developing roller being configured to carry the developer;

a supply roller arranged at the developer accommodation member, the supply roller being configured to supply the developer to the developing roller; and a charging member brought into sliding contact with the supply roller, wherein the charging member at a portion brought into sliding contact with the supply roller is formed of a material which is positioned on a side of the first polarity on a triboelectric series relative to the supply roller.

2. The developer unit according to claim 1, wherein one of the supply roller and the charging member is formed of a foamed elastic body.

3. The developer unit according to claim 1, wherein the supply roller and the developing roller are configured to rotate in a same direction.

4. The developer unit according to claim 3, wherein the developer accommodation member comprises:

a first wall surface that defines a developing chamber at which the developing roller and the supply roller are arranged;

a second wall surface that defines a developer accommodation chamber communicating with the developing chamber and configured to accommodate the developer therein; and a demarcation portion that demarcates the developer accommodation chamber and the developing chamber, and wherein the charging member is arranged in a developer collection path formed between the supply roller and the demarcation portion.

5. The developer unit according to claim 4, wherein the developer accommodation chamber, the demarcation portion, the charging member, the supply roller and the developing roller are arranged in the developer accommodation member in this order.

6. The developer unit according to claim 3, wherein the developer accommodation member comprises a demarcation portion that demarcates a developing chamber and a developer accommodation chamber, the developing chamber at which the developing roller and the supply roller are arranged, and the developer accommodation chamber communicating with the developing chamber and configured to accommodate the developer therein, and wherein the charging member is arranged on a downstream side in a rotational direction from a merging portion, the merging portion being defined at a position where a developer collection path and a developer supply path, the developer collection path being defined between the supply roller and the demarcation portion, and the developer supply path being defined from the developer accommodation chamber to the developing chamber.

7. The developer unit according to claim 1, wherein the developer accommodation member is divided into two parts comprising:

a developing case that defines a developing chamber at which the developing roller and the supply roller are arranged; and a developer case that defines a developer accommodation chamber communicating with the developing chamber and configured to accommodate the developer therein, and wherein the developer case is detachable from the developing case.

8. The developer unit according to claim 1, wherein an image formation width is defined on a surface of the supply roller along an axis direction of the supply roller, and wherein the charging member extends along the axis direction to contact with at least the image formation width of the supply roller.

9. The developer unit according to claim 8, wherein the charging member extends along the axis direction to contact with inside and outside the image formation width of the supply roller.

10. A process device comprising:

a developer unit, the developer unit which comprises:

a developer accommodation member configured to accommodate a developer, the developer having charging polarity to a first polarity;

a developing roller arranged at the developer accommodation member, the developing roller being configured to carry the developer;

a supply roller arranged at the developer accommodation member, the supply roller being configured to supply the developer to the developing roller; and a charging member brought into sliding contact with the supply roller, wherein the charging member at a portion brought into sliding contact with the supply roller is formed of a material which is positioned on a side of the first polarity on a triboelectric series relative to the supply roller; and an image carrier on which the developer is supplied from the developer unit and a developer image is formed.

11. An image forming apparatus capable of forming an image on a recording sheet, the image forming apparatus comprising:

a process device comprising a developer unit and an image carrier on which a developer is supplied from the developer unit and a developer image is formed, the developer unit comprising:

a developer accommodation member configured to accommodate the developer, the developer having charging polarity to a first polarity;

a developing roller arranged at the developer accommodation member, the developing roller being configured to carry the developer;

a supply roller arranged at the developer accommodation member, the supply roller being configured to supply the developer to the developing roller; and a charging member brought into sliding contact with the supply roller, wherein the charging member at a portion brought into sliding contact with the supply roller is formed of a material which is positioned on a side of the first polarity on a triboelectric series relative to the supply roller;

an exposure device configured to expose the image carrier of the process device and form an electrostatic latent image on the image carrier;

a transfer device configured to transfer a developer image formed by the process device to the recording sheet; and a fixing device configured to fix an image formed on the recording sheet.

* * * * *